US009004153B2

(12) United States Patent
Andersson et al.

(10) Patent No.: US 9,004,153 B2
(45) Date of Patent: Apr. 14, 2015

(54) PORT OPENING OF BRAZED HEAT EXCHANGER

(75) Inventors: Sven Andersson, Hässleholm (SE); Svante Hoberg, Åstorp (SE); Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 855 days.

(21) Appl. No.: 13/139,963

(22) PCT Filed: Dec. 11, 2009

(86) PCT No.: PCT/EP2009/066930

§ 371 (c)(1), (2), (4) Date: Aug. 17, 2011

(87) PCT Pub. No.: WO2010/069873

PCT Pub. Date: Jun. 24, 2010

(65) Prior Publication Data

US 2011/0290462 A1 Dec. 1, 2011

(30) Foreign Application Priority Data

Dec. 17, 2008 (SE) ..... 0802594

(51) Int. Cl.
*F28F 3/08* (2006.01)
*F28D 9/00* (2006.01)
*F28F 3/04* (2006.01)

(52) U.S. Cl.
CPC ..... *F28D 9/005* (2013.01); *F28F 3/046* (2013.01); *F28F 2225/00* (2013.01)

(58) Field of Classification Search
USPC ..... 165/167, 166, 177
See application file for complete search history.

(56) References Cited

U.S. PATENT DOCUMENTS 4,987,955 A * 1/1991 Bergqvist et al. ..... 165/167
5,462,113 A * 10/1995 Wand ..... 165/167

(Continued)

FOREIGN PATENT DOCUMENTS

JP 1-503558 11/1989
JP H-11287581 10/1999

(Continued)

OTHER PUBLICATIONS

International Search Report from International Application No. PCT/EP2009/066930 mailed Mar. 29, 2010 (Form PCT/ISA/210).

(Continued)

*Primary Examiner* — Mohammad M Ali
*Assistant Examiner* — Raheena Rehman
(74) *Attorney, Agent, or Firm* — Merchant & Gould P.C.

(57) ABSTRACT

A brazed heat exchanger (100, 200) comprises a number of heat exchanger plates (110, 120, 130, 140, 150) provided with a pressed pattern of ridges and grooves to form flow channels for media to exchange heat between neighboring heat exchanger plates (110,120,130,140,150). The flow channels are in selective fluid communication with port openings (160). The port openings (160) are provided with dented surfaces (180; 280) being arranged along an interior circumference of the port openings (160) and comprising ridges (181; 282) and grooves (182; 281), said ridges (181; 282) and grooves (182; 281) being arranged such that a ridge (181; 282) of one heat exchanger plate (110, 120, 130, 140, 150) contacts a groove (182; 281) of a neighboring plate (110,120, 130,140,150) to form a honeycomb pattern. The dented surfaces (180; 280) are located such that they at least partly surround the port opening (160), and a gable surface (184) is removed to increase a surface area open to fluid flow from the port openings (160) to the flow channels.

1 Claim, 3 Drawing Sheets

Fig. 1 (037)

(56) References Cited

U.S. PATENT DOCUMENTS

| | | | | |
|---|---|---|---|---|
| 5,924,484 | A | 7/1999 | Andersson et al. | |
| 6,073,687 | A * | 6/2000 | Jensen et al. | 165/167 |
| 6,305,466 | B1 * | 10/2001 | Andersson et al. | 165/140 |
| 6,394,179 | B1 * | 5/2002 | Blomgren et al. | 165/167 |
| 7,424,908 | B2 * | 9/2008 | Blomgren | 165/167 |
| 2006/0048927 | A1 * | 3/2006 | Blomgren | 165/167 |
| 2007/0089871 | A1 * | 4/2007 | Andersson et al. | 165/167 |
| 2008/0196874 | A1 * | 8/2008 | Bertilsson et al. | 165/167 |
| 2009/0159251 | A1 * | 6/2009 | Blomgren | 165/170 |

FOREIGN PATENT DOCUMENTS

| | | |
|---|---|---|
| JP | 2000-346582 | 12/2000 |
| SE | 458 884 | 5/1989 |

OTHER PUBLICATIONS

International Search Report from International Application No. PCT/EP2009/066930 (Form PCT/ISA/237).

Japanese Examination Report for JP 2011-541355 mailed Oct. 8, 2013.

* cited by examiner

Fig. 1 (037)

PORT OPENING OF BRAZED HEAT EXCHANGER

This application is a National Stage Application of PCT/EP2009/066930, filed 11 Dec. 2009, which claims benefit of Ser. No. 0802594-2, filed 17 Dec. 2008 in Sweden and which applications are incorporated herein by reference. To the extent appropriate, a claim of priority is made to each of the above disclosed applications.

FIELD OF THE INVENTION

The present invention relates to a brazed heat exchanger comprising a number of heat exchanger plates provided with a pressed pattern of ridges and grooves to form flow channels for media to exchange heat between neighboring heat exchanger plates, said flow channels being in selective fluid communication with port openings.

PRIOR ART

Heat exchangers are used for exchanging heat between fluid media, and generally comprise a number of plates stacked onto one another such that flow channels are formed between the plates. Usually, port openings are provided to allow selective fluid flow in and out from the flow channels, which may be formed by a pattern of ridges and grooves arranged on the plates, said ridges and grooves of the plates being arranged to contact one another to hold the plates on a distance from one another.

There are many types of heat exchangers on the market, for example tube and fin heat exchangers, air-liquid heat exchangers and plate heat exchangers.

Plate heat exchanger are often used for exchanging heat between two media in liquid form, but an emerging market for plate heat exchangers is heat pumps, wherein the plate heat exchanger is used for exchanging heat between a low temperature liquid (e.g. brine) and a coolant. Generally, such heat exchangers are designed to withstand a pressure of some tens of bars, which is the necessary pressure in heat pump circuits using commonly used coolants.

In recent years, there has been a general trend towards the use of carbon dioxide as the coolant in heat pump applications. There are some reasons that carbon dioxide has been a popular choice, mainly that the high temperature COP (efficiency) is high for carbon dioxide, which is highly desired if tap water is to be produced by the heat pump.

However, the use of carbon dioxide as the coolant means that the heat exchanger must withstand a high coolant pressure, up to 140 bars. Until now, no plate heat exchangers have been able to withstand such pressures.

A common way of manufacturing a plate heat exchanger is to braze the heat exchanger plates together to form the heat exchanger. Brazing a heat exchanger means that a surplus of a number of plates are provided with a brazing material, after which the plates are stacked onto one another and placed in a furnace having a temperature sufficiently hot to melt the brazing material. The melting of the brazing material means that the brazing material (partly due to capillary forces) will concentrate in areas where the heat exchanger plates are in close vicinity of one another, i.e. contact points between ridges and grooves of neighboring plates, and after the temperature of the furnace has been lowered, the brazing material will solidify, and the heat exchanger plates will be joined to one another to form a compact and strong heat exchanger. With the type of heat exchanger plates mentioned above, the flow channels between the plates are formed by contact points emerging from contact points at crossings between ridges and grooves of neighboring plates.

It is well known by persons skilled in the art that brazed heat exchanger tend to break close to the port openings if subjected to high pressures. This is due to the fact that an internal pressure acts to tear brazed plates apart, and the tearing apart force is highest around the port openings, since the port opening represents a surface where the contact point concentration is low.

SE 458 884 discloses a heat exchanger wherein the port openings are reinforced by the provision of surfaces arranged around an internal circumference of the port openings, wherein the surfaces are provided with high and low portions arranged to engage corresponding portions of neighboring plates to form a honeycomb structure strengthening the port opening. The solution does give an increased strength to the port opening, however with some major drawbacks: firstly, the surface area from the port opening to the flow channels will be significantly smaller than for ports without the honeycomb structure; secondly, much of the high and low areas of neighboring plates contacting one another will not transfer any force.

The object of the present invention is to provide a port opening of a brazed plate heat exchanger having an increased strength to withstand high internal pressures, while retaining a large surface area being open for communication between the flow channels and the port openings.

SUMMARY OF THE INVENTION

According to the invention, this and other problems are solved by dented surfaces comprising ridges and grooves, said ridges and grooves being arranged such that a ridge of one heat exchanger plate contacts a groove of a neighboring plate, the dented surfaces being located such that they at least partly surround the port opening, wherein material in a wall portion extending perpendicular to said ridges and grooves is removed.

BRIEF DESCRIPTION OF THE DRAWINGS

Hereinafter, the invention will be described with reference to the appended drawings, wherein.

DESCRIPTION OF EMBODIMENTS

Figure 1:
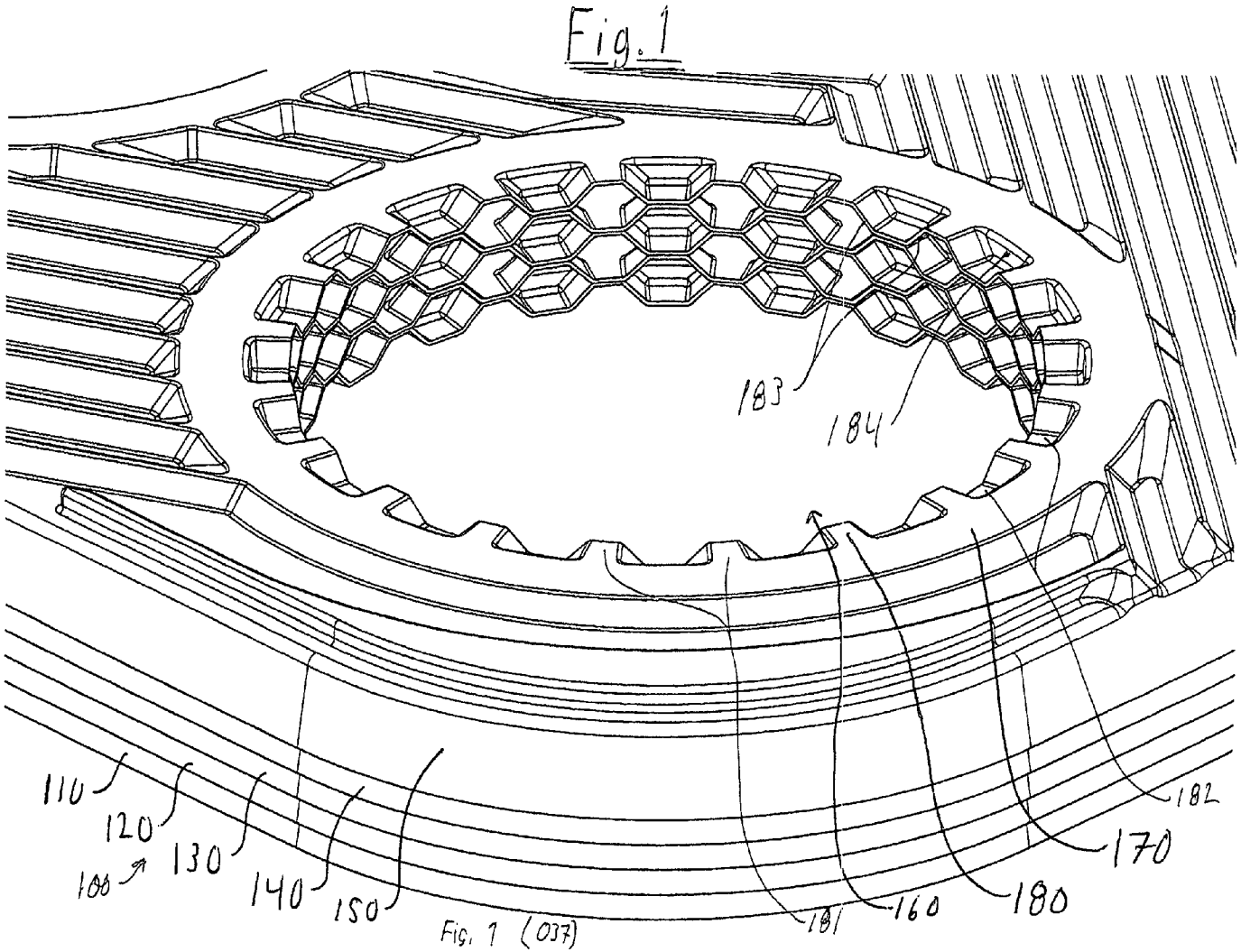
FIG. 1 is a schematic, partly sectioned, perspective view of first embodiment of a port opening of a heat exchanger according to the present invention.

With reference to FIG. 1, a brazed heat exchanger 100 according to the prior art comprises a number of heat exchanger plates 110, 120, 130 140, 150 stacked onto one another to form the heat exchanger 100. The heat exchanger plates 110, 120, 130, 140 and 150 are each provided with at least four port openings (only one port opening 160 is shown), a pattern of ridges and grooves adapted to hold two neighboring plates on a distance from one another such that flow channels are formed between the plates, and sealing surfaces 170. The sealing surfaces 170 of neighboring plates cooperate to either seal off communication between the port opening 160 and the flow channels formed by the heat exchanger plates or allow communication between the port opening 160 and the flow channels. Normally, this is achieved by alternating sealing surfaces 170 having a large press depth with sealing surfaces having a small press depth on neighboring plates.

Moreover, heat exchanger plates of brazed heat exchangers generally comprise a skirt extending around the periphery of the plate; skirts of neighboring plates will contact one another and be brazed together an form a strong, liquid tight edge surrounding the heat exchanger.

In order to reinforce the port opening 160, the surface 170, an inwardly extending surface of which being denoted 180, extends toward the port opening. The surface 180 is "dented", i.e. it is provided with pressed ridge surfaces 181 and groove surfaces 182, the ridge surfaces and groove surfaces being interconnected by intermediate surfaces 183. The press depth of the ridges and grooves equals the press depths of the press depths of the sealing surfaces' 170 small and large press depths. A gable surface 184 connects the sealing surface 170 with the intermediate surfaces 183 and the groove surfaces 182.

Figure 2:
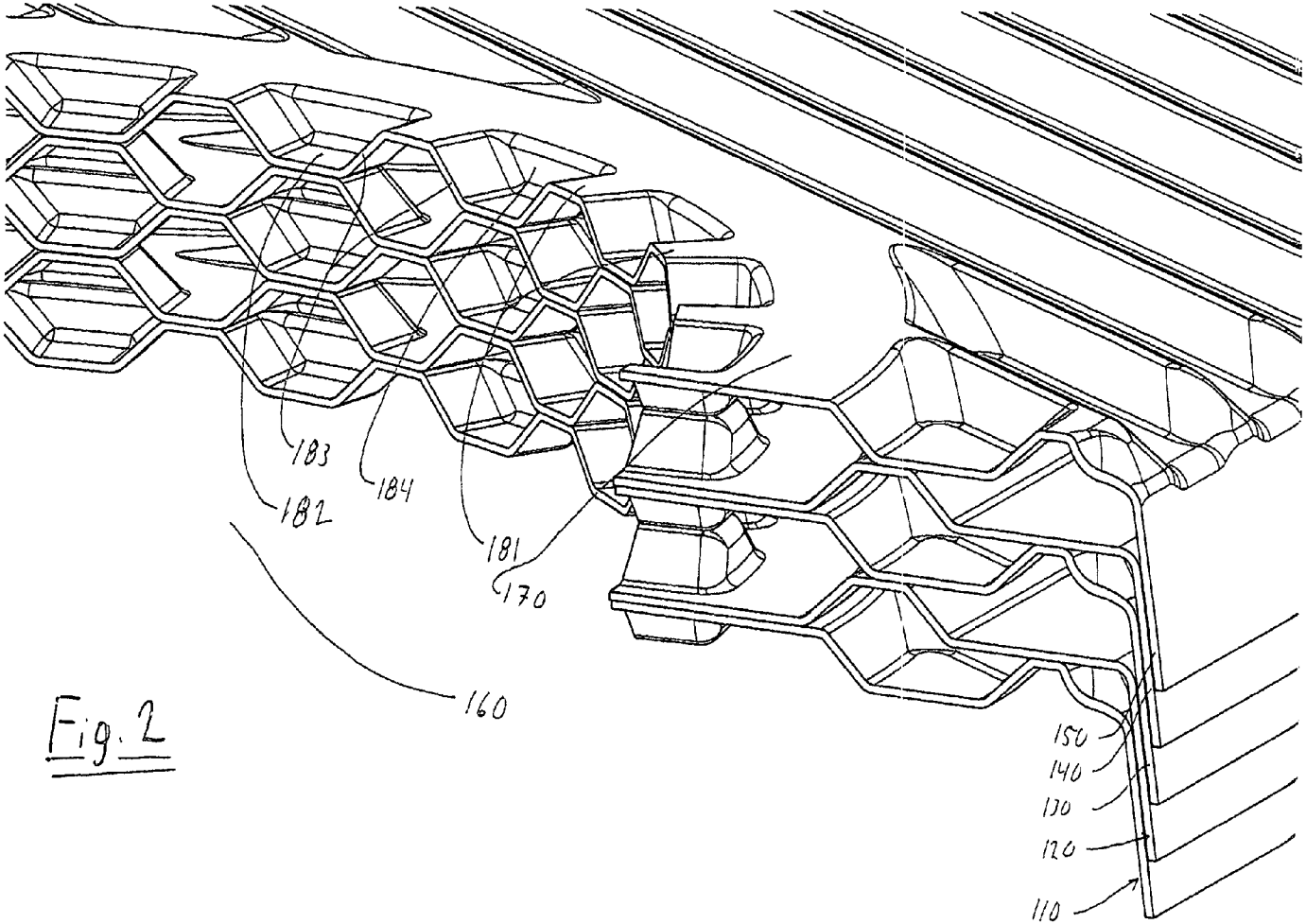
FIG. 2 is a schematic, partly sectioned, perspective view of the port opening of FIG. 1 in a larger scale.

As can be seen in FIG. 1, the dented surfaces 180 of neighboring plates interact to form a honeycomb matrix in the port, since groove surfaces 182 of one plate will contact corresponding surfaces 181 of another plate. The connection between those surfaces will be brazed together, and since correspondingly mating surfaces of the dented surfaces 180 of neighboring plates will contact one another, such surfaces will be brazed together. FIG. 2 shows the port opening 160 in a sectioned diameter in a larger scale.

As can be understood, not all honeycomb openings resulting from the dented surfaces 180 of neighboring plates are "active", i.e. open for a fluid flow from the port to the flow channels formed by the pattern of ridges and grooves adapted to hold two neighboring plates on a distance from one another. As a result of this, the flow area from the port to the flow channels will be roughly halved as compared to a port opening formed by plates without the dented surface 180.

In order to restore most of the flow area of a port provided with the dented surface 180, it is, according to the present invention, possible to remove the material forming the gable surface 184; such removal of material will make every honeycomb opening active, i.e. allow flow from the port opening to the flow channels.

It may be advantageous to remove the material forming the gable surfaces prior to a pressing operation forming the heat exchanger plates.

Figure 3:
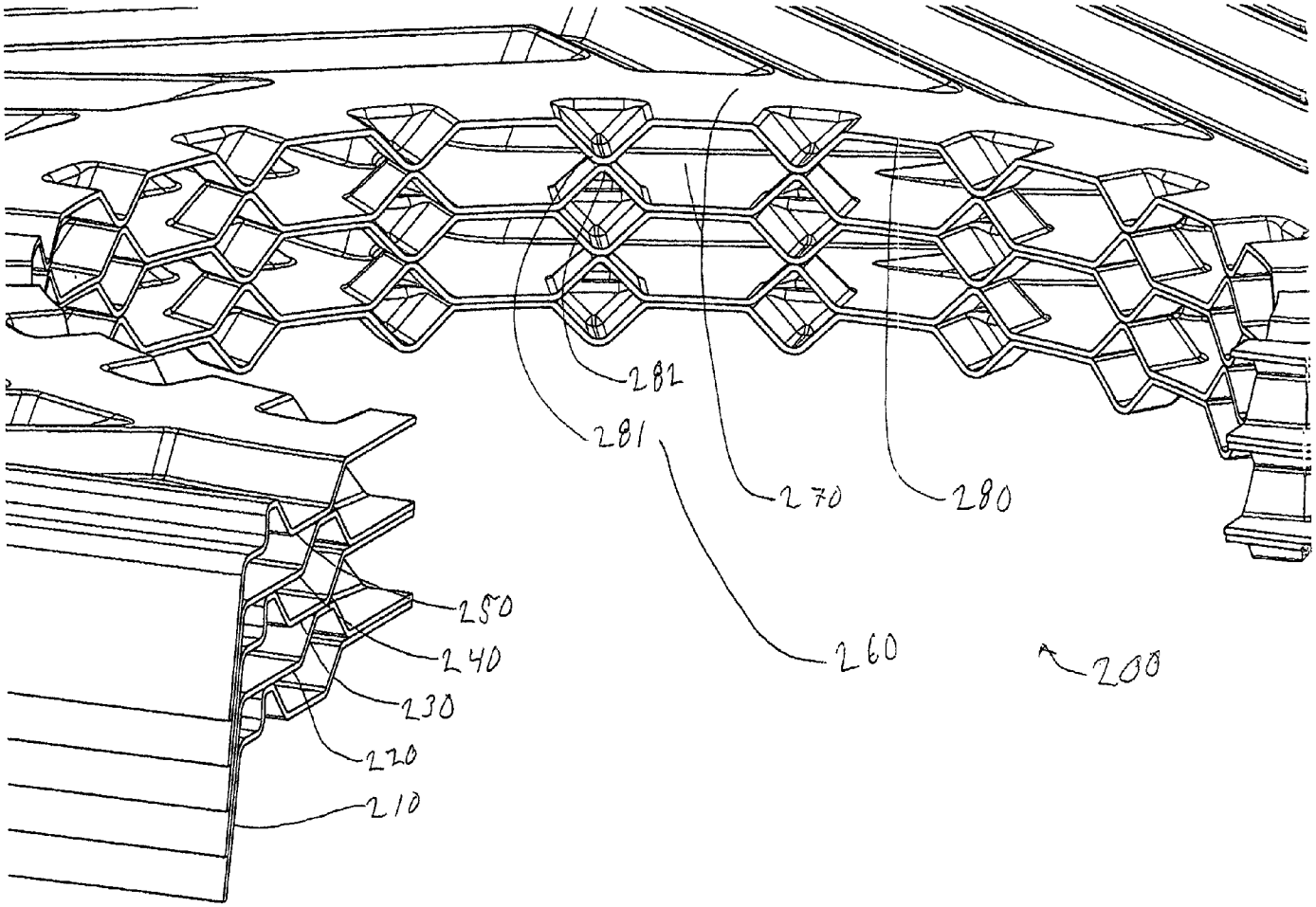
FIG. 3 is a schematic, partly sectioned, perspective view of a second embodiment of a port opening according to the present invention.

Another way of increasing the flow area from the port opening is to use the embodiment of FIG. 3. A heat exchanger 200 according to the embodiment of FIG. 3 comprises heat exchanger plates 210 220, 230, 240, 250 provided with ridges and grooves adapted to hold the heat exchanger plates on a distance from one another under formation of flow channels for fluids to exchange heat with one another.

The flow channels formed by the heat exchanger plates are in selective fluid communication with port openings 260 (only one shown in FIG. 3) by sealing surfaces 270, which are provided on one of two heights, in a way such that a sealing surface provided on one height neighbors two sealing surfaces of the other height. In this way, a selective communication between the port opening and the flow channels is achieved; one port opening 260 will fluidly communicate with every other flow channel.

This far, the heat exchanger according to the second embodiment is equal to the heat exchanger of the first embodiment. However, according to the first embodiment, the dented surface 180 is provided with ridge surfaces 181 and groove surfaces 182, whereas the heat exchanger of the second embodiment comprises narrow, V-like grooves or V-like ridges 281 and 282, respectively.

Compared to the first embodiment, the heat exchanger according to the second embodiment exhibits a larger flow area, while retaining most of the strength of the port opening of the heat exchanger of the first embodiment.

The connection between the ridges and grooves, or the ridge surfaces and the groove surfaces, will make the port area very strong, since forces may be transmitted through the brazing connections, hence transferring forces from an underside of the heat exchanger to an upper side of the heat exchanger.

Moreover, providing dented surfaces according to the invention may alleviate another problem connected to the manufacturing of brazed heat exchangers; it is a well-known problem that heat exchangers tend to "shrink" during the brazing operation, especially in the vicinity of the port openings. This shrinking is due to the melting of the brazing material. The melting of the brazing material occurs in the entire heat exchangers, but the ridges and grooves adapted to hold two neighboring plates on a distance from one another under formation of flow channels limits the amount of shrinking for the heat exchanging surfaces.

On prior art heat exchangers, however, the port openings are subjected to a more severe shrinking, since melting of brazing material arranged on the skirts extending around the heat exchanger plates will result in a larger shrinking with regards to the height of the exchanger. By the provision of the dented surfaces, a limitation of the shrinking in the vicinity of the port openings can be achieved, since the surfaces 181 and 182 of neighboring plates will limit the shrinkage to the same amount that is present for the areas comprising the ridges and grooves adapted to hold two neighboring plates on a distance from one another.

In another embodiment of the invention, the dented surface 180, 280 is only provided on a portion of the port's circumference; if the shrinking problems referred to above are not considered as a problem, it might be advantageous to provide the dented surface 180 only on areas not closely surrounded by the skirt surrounding each heat exchanger plate.

The invention claimed is:

1. A brazed heat exchanger, comprising a number of heat exchanger plates provided with a pressed pattern of first ridges and grooves to form flow channels for media to exchange heat between neighboring heat exchanger plates, said flow channels being in selective fluid communication with port openings wherein dented surfaces being arranged along an interior circumference of the port openings and comprising second ridges and grooves, said second ridges and grooves being arranged such that the second ridge of one heat exchanger plate contacts the second groove of a neighboring plate to form a honeycomb pattern, the dented surfaces being located such that they at least partly surround the port opening, wherein a gable surface is removed to increase a surface area open to fluid flow from the port openings to the flow channels.

* * * * *